United States . atent [19]

Robinson et al.

[11] Patent Number: 4,529,962

[45] Date of Patent: Jul. 16, 1985

[54] PORTABLE DOOR S ;NAL

[76] Inventors: Vancortla T. Robinson, 6701 Mallard's ›ve Rd. Apt. 14D, Jupiter, F 33458; George Spector, 233 Broad ıy, Rm. 3615, New York, N.Y 10007

[21] Appl. No.: 535,766

[22] Filed: Sep. 26, 1 3

[51] Int. Cl.[3] ..... G08B 23/00

[52] U.S. Cl. ..... 340/321; 200/61.62

[58] Field of Search ..... 340/321, 392, 586; 200/61.62, 61.58

[56] Reference Cited

U.S. PATENT I CUMENTS

| | | | |
|---|---|---|---|
| 1,464,788 | 8/1923 | Wakef l | 200/61.62 |
| 1,892,073 | 12/1932 | Nichol | 200/61.62 |
| 1,900,906 | 3/1933 | Brown | 340/321 |
| 2,136,677 | 11/1938 | Doeppel | 200/61.62 |
| 2,350,413 | 6/1944 | Ordman | 340/321 |
| 3,327,300 | 6/1967 | Birrenkett | 200/61.62 |
| 3,824,576 | 7/1974 | Pioch | 200/61.62 |
| 4,012,731 | 3/1977 | Solomon | 200/61.62 |

*Primary Examiner*—James J. Groody

[57] ABSTRACT

A portable door signal apparatus is provided and consists of a thin flexible insulating strap having a removably mounted housing with a battery and signaling device at top of one end with a push button switch mounted to top of other end. The push button switch is operatively connected to the battery and signaling device. The strap is bent around the edge of the door and held against the door so that a person can activate the push button on one side of the door to operate the signaling device on the other side of the door.

2 Claims, 6 Drawing Figures

PORTABLE DOOR SIGNAL

BACKGROUND OF THE INVENTION

The instant invention relates generally to signaling systems and more specifically it relates to a portable door signal apparatus.

In case of an emergency, deaf people, hard of hearing people and people who cannot hear a knock on their door the situation can become quite dangerous. In the event of a fire, for example, when a building must be evacuated quickly this can pose a problem so accordingly it is in need of an improvement.

Numerous signaling systems have been provided in prior art that are adapted to produce an attention-arresting sound signal. For example U.S. Pat. Nos. 2,816,280; 2,968,032 and 3,168,730 all are illustrative of such prior art. While these units may be suitable for the particular purpose to which they address, they would not be suitable for the purposes of the present invention as heretofore described.

SUMMARY OF THE INVENTION

A principle object of the present invention is to provide a portable door signal apparatus that can be activated on one side of the door to operate a signaling device on the other side of the door.

Another object is to provide a portable door signal apparatus that can be bent around the edge of the door and held against the door thereto.

An additional object is to provide a portable door signal apparatus that can be activated by turning a door knob for use as a security device.

A further object is to provide a portable door signal apparatus that is simple and easy to use.

A still further object is to provide a portable door signal apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
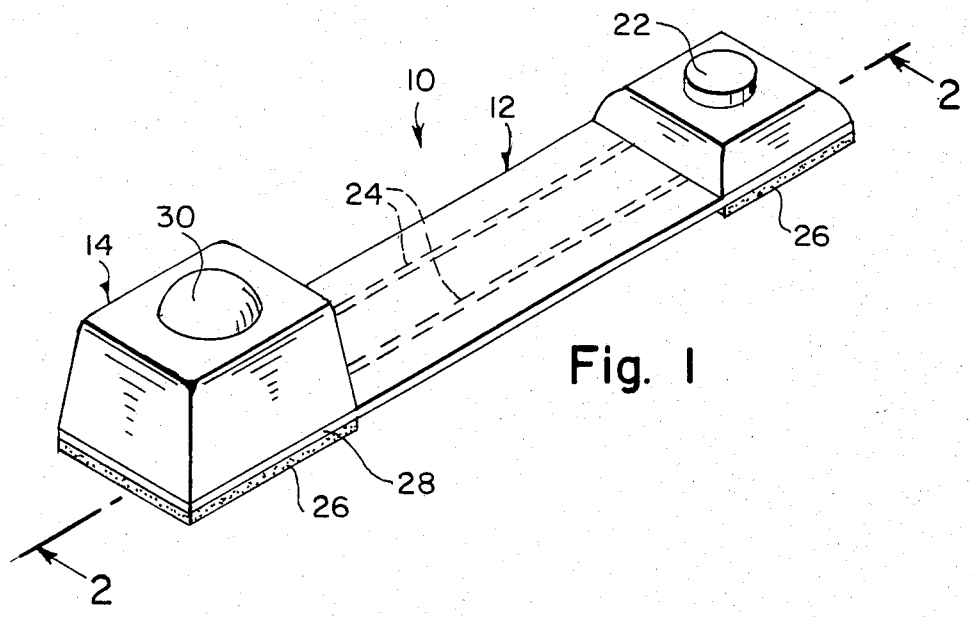
FIG. 1 is a perspective view of the invention.
Figure 2:
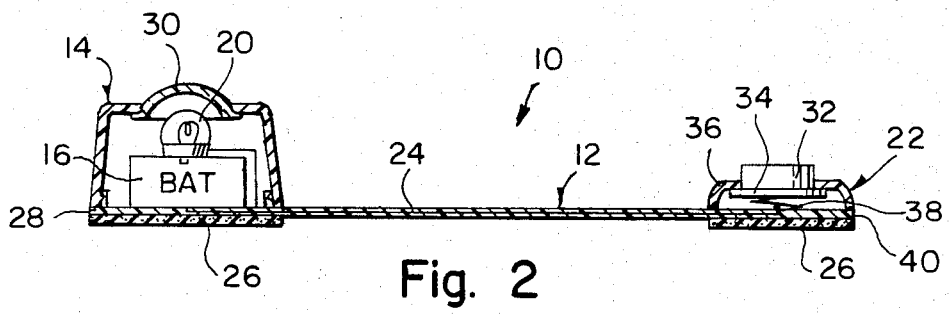
FIG. 2 is a cross sectional view taken along line 2—2 in FIG. 1.
Figure 3:
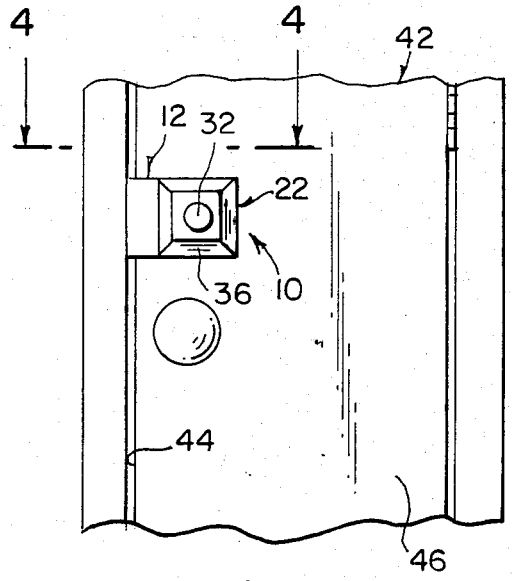
FIG. 3 is a front view of a door with the invention installed.
Figure 4:
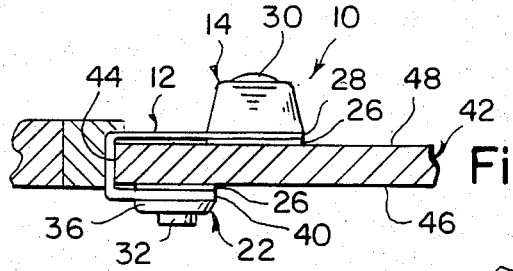
FIG. 4 is a cross sectional view taken along line 4—4 in FIG. 3.

Turning now descriptively to the drawings, in which similar reference characters denote similar elements throughout the several views, FIGS. 1 through 4 illustrates a portable door signal apparatus 10. The apparatus 10 consists of a strap 12, a housing 14, a battery 16, a signaling device 20, a push button switch 22, foil strips or thin wires 24 and strong mounting tape 26.

The strap 12 is made of a thin flexible insulating material such as nylon plastic. The housing 14 is hollow and removably mounted to top of one end 28 of the strap 12. A light dome 30 is provided in top of housing 14. The battery 16 can be a 9-volt type and the signaling device 20 can be a visual signaling device, such as a lamp or a flasher (not shown). The battery 16 and signaling device 20 are both mounted within the housing 14 and can be changed when needed.

The push button switch 22 consists of a insulating button member 32 having a metallic contact plate 34 within a housing 36 pushing against the pressure of a non-metallic spring 38. The push button switch 22 is mounted to top of other end 40 of the strap 12.

The pair of parallel spaced foil strips or thin wires 24 extend through the strap 12 for operatively connecting the push button switch 22, the battery 16 and the signaling device 20.

The strong mounting tape 26 can be of two pieces. One piece is placed under the strap 12 at end 28 while the other piece is placed under the strap 12 at end 40. The tape 26 holds the strap 12 at ends 28 and 40 against a door 42 when the strap 12 is bent around edge 44 of the door 42 so that a person (not shown) can activate the push button switch 22 on one side 46 of the door 42 to operate the signaling device 20 on other side 48 of the door 42 (see FIG. 4).

The housing 14 can be modified so that instead of a light dome 30 the top of the housing 14 can be perforated (not shown) so that an audible signaling device such as a buzzer, siren or other transmitter unit (not shown) can be used instead of the visual signaling device 20.

Figure 5:
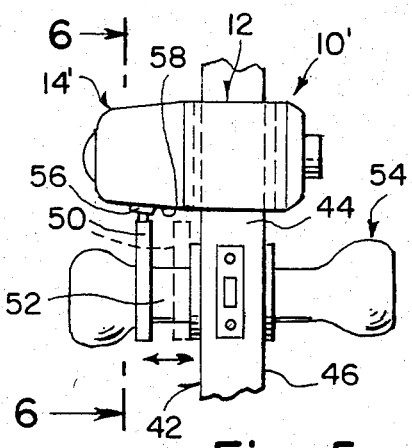
FIG. 5 is an end view of a modification installed on a door for use as a security device.
Figure 6:
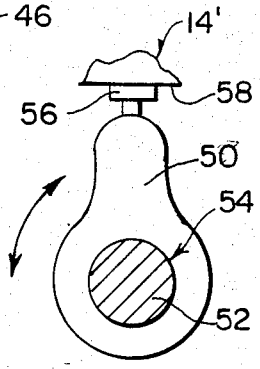
FIG. 6 is a cross sectional view taken along line 6—6 in FIG. 5.

FIGS. 5 and 6 show a modified door signal apparatus 10' that further contains a cam 50 to a shaft 52 on one side of a door knob 54 and an auxiliary push button switch 56 mounted to a side 58 of the housing 14'. The strap 12 is bent around edge 44 of the door 42 adjacent the door knob 54 so that the cam 50 can come into contact with the auxiliary push button switch 56 when the door knob 54 is manually turned at other side 46 to activate the signaling device 20 thereof for use as a security device.

The cam 50 can be manually moved along the shaft 52 of the door knob 54 out of position as shown in dotted lines so as not to come into contact with the auxiliary push button switch 56 thus turning off the security device.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A portable door signal apparatus which comprises:

(a) a thin flexible insulating strap;

(b) a housing that is removeably mounted to top of one end of said strap;

(c) a battery mounted within said housing;

(d) a signaling device mounted within said housing;

(e) a push button switch mounted to top of other end of said strap;

(f) means for operatively connecting said push button switch, said battery and said signaling device, said means extending through said strap; and (g) means for holding said strap against a door when said strap is bent around edge of the door so that a person can activate said push button switch on one side of the door to operate said signaling device on other side of the door wherein said signaling device is visual signaling device such as a lamp in further combination with;

(h) a cam mounted to shaft on one side of a door knob; and (i) an auxiliary push button switch mounted to a side of said housing whereby said strap is bent around edge of the door adjacent the door knob so that said cam can come into contact with said auxiliary push button switch when the door knob is manually turned at other side to activate said signaling device thereof for use as a security device, wherein said means for holding said strap against the door when said strap is bent around edge of the door is a strong mounting tape.

2. A portable door signal apparatus as recited in claim 1, wherein said cam can be manually moved along the shaft of the door knob out of position so as not to come into contact with said auxiliary push button switch thus turning off the security device.

* * * * *